United States Patent [19]

Brown

[11] 4,112,914

[45] Sep. 12, 1978

[54] COMBINED FIREPLACE HOOD AND HEATING UNIT

[76] Inventor: Rex M. Brown, 435 E., 1st N., Smithfield, Utah 84335

[21] Appl. No.: 606,063

[22] Filed: Aug. 20, 1975

Related U.S. Application Data

[63] Continuation-in-part of Ser. No. 538,102, Jan. 2, 1975, abandoned.

[51] Int. Cl.[2] ..... F24B 7/04

[52] U.S. Cl. ..... 126/121; 126/142; 126/202; 237/51

[58] Field of Search ..... 126/121, 202, 134, 138, 126/139, 140, 142; 237/51

[56] References Cited

U.S. PATENT DOCUMENTS

| | | | |
|---|---|---|---|
| 1,766,601 | 6/1930 | Cesa | 126/121 |
| 2,052,643 | 9/1936 | Modine | 126/121 |
| 2,196,795 | 4/1940 | Harris | 126/121 |
| 2,296,354 | 9/1942 | Kraus | 126/134 X |
| 2,322,016 | 6/1943 | Hardeman | 126/121 X |
| 2,359,197 | 9/1944 | Brooks | 126/121 |
| 2,362,562 | 11/1944 | Austin | 126/121 |
| 2,429,748 | 10/1947 | Dollinger | 126/121 |
| 2,787,997 | 4/1957 | Asbury | 126/121 |
| 2,828,078 | 3/1958 | Snodgrass | 126/121 X |
| 3,224,429 | 12/1965 | Quittner | 126/202 |
| 3,452,737 | 7/1969 | Pellegrino et al. | 126/121 |
| 3,901,212 | 8/1975 | Stites | 126/121 |
| 3,911,894 | 10/1975 | Richard, Jr. | 126/121 |
| 3,926,174 | 12/1975 | Bell | 126/121 |
| 3,976,047 | 8/1976 | Breen et al. | 126/121 |

FOREIGN PATENT DOCUMENTS

| | | | |
|---|---|---|---|
| 1,231,446 | 9/1960 | France | 126/4 |
| 177,455 | 3/1922 | United Kingdom | 126/121 |
| 1,095,644 | 12/1967 | United Kingdom | 126/121 |
| 4,445 of | 1913 | United Kingdom | 126/121 |
| 213,359 | 4/1924 | United Kingdom | 126/121 |
| 759,793 | 10/1956 | United Kingdom | 126/121 |

*Primary Examiner*—William F. O'Dea
*Assistant Examiner*—Harold Joyce
*Attorney, Agent, or Firm*—Barnes, Kisselle, Raisch & Choate

[57] ABSTRACT

A combined fireplace hood and heating unit which is adapted to be mounted as an assembled unit to the lintel of a pre-existing fireplace. The unit includes a fireplace hood formed as an elongated housing, and a pair of U-shaped heat exchanging ducts each having a rectangular cross section and each extending in cantilever fashion from the rear of the housing. Brackets are provided at the front-to-back center of gravity of the unit for suspending the unit from a fireplace lintel such that the housing is carried externally of the fireplace and the heat exchanging ducts extend rearwardly into the fireplace over the fire or hearth area. The housing itself is the only connecting duct between the blowers and the intake vent, so that cool air entering through the intake vent tends to circulate throughout the housing and cool all components therein before being forced through the heat exchangers.

32 Claims, 9 Drawing Figures

COMBINED FIREPLACE HOOD AND HEATING UNIT

This application is a continuation-in-part of application Ser. No. 538,102 filed Jan. 2, 1975 and now abandoned.

The present invention relates to fireplace heating units and, more particularly, to a combined fireplace hood and heating unit which may be installed as an assembled unit into a pre-existing conventional residential fireplace.

It is well recognized in the home heating art that a fireplace, per se, provides an inefficient means for heating a room since most of the heated convection currents pass up the chimney, leaving only the radiation from the fire as the primary source of room heat. Devices for supplementing the heating capability of a fireplace have been previously introduced. Such devices often take the form of hollow members directly exposed to a fire in the fireplace, so that air is drawn from the room either by a blower or by heat convection, heated in the hollow members and then discharged into the room. Many devices of this type take the form of fireplace grates wherein the hollow members support and are in direct contact with the burning fuel. Being exposed to the maximum heat of the fire, the hollow membes or grates rapidly become corroded even though such membes may be fabricated of relatively heavy pipe material. Furthermore, air discharged into the room from grate devices of this type tends to be at a dangerously high temperature, and components associated therewith are often exposed to such high temperatures near the discharge vent that severe burns could occur if the components are touched and/or the components may themselves sustain heat damage. For these and other reasons, heating devices of this type tend to be short lived and subject to frequent repair. Gratetype devices of the character described are shown, for example, in U.S. Pat. Nos. 2,828,078; 3,001,521; 3,452,737 and 3,635,211.

Yet another class of devices previously provided to enhance the heating capability of a fireplace is of the type generally intended to be built into the fireplace as the fireplace is originally constructed. Although devices of this type may prove satisfactory in many instances, they have an obvious disadvantage in that they are not readily adaptable to the large number of cases in which the fireplace in question is already constructed. Later installation of such devices would usually require major reconstruction of a pre-existing fireplace and would, therefore, be generally unsatisfactory in such applications. Devices of the type in question are shown, for example, in U.S. Pat. Nos. 1,706,142; 1,766,601; 2,120,977 and 2,296,354. Such devices are also shown in British Pat. Nos. 4,445 and 759,793.

It is an object of the present invention to provide a heating unit specifically adapted to be easily and rapidly mounted to a pre-existing fireplace.

It is another object of the present invention to provide a fireplace heating unit which has the external appearance of and serves the same purpose as a conventional fireplace hood.

Further objects of the present invention are to provide a combined fireplace hood and heating unit in which a large volume of heated air is provided at a relatively low exhaust velocity; in which the internal components, and particularly the blower motor, are cooled by air returned from the room; in which the exposed hood portion of the heating unit external to the fireplace is cool to the touch; in which the heat exchanging portion of the unit is removed from direct contact with materials burning in the fireplace; and which provides efficient circulation of heated air within the room.

The present invention broadly comprises a combination of an ornamental fireplace hood and a forced air heating unit. The hood portion is in the form of an elongated housing in which a blower is mounted. The housing is also equipped with a cool air intake vent and at least one warm air discharge vent. A heat exchanger in the form of a U-shaped duct, preferably having a rectangular cross section, passes from the blower through a rear wall of the housing, extends in cantilever fashion over the fire, returns through the wall of the housing and connects to the discharge vent. Brackets are carried by the housing for mounting the housing and heat exchangers, as an assembled unit, to the lintel of a pre-existing fireplace. The brackets are preferably located at the approximate front-to-back center of gravity of the combined unit to facilitate the mounting operation. In assembly to a fireplace, the housing is carried externally of the fireplace.

A thermostat carried by the housing energizes the blower motor only when the temperature within the fireplace has reached a predetermined level, so that cold air will not be discharged into the room. Since the housing itself is the only connection (ie., air flow duct work) between the blower and the intake vent, cool air entering through the intake vent tends to circulate throughout the housing before entering the blower, thereby cooling both the housing itself and all components therein, including the blower motor. After being warmed over the fire, the air is discharged into the room through the discharge vent at a low velocity, at a warm but not hot temperature. The rectagular cross sectional shape of the heat exchanger which is presently preferred insures intimate contact between the exchanger outer surface and the warming convection currents rising from the fire. This contact promotes a substantially uniform heat transfer and a gradual but highly efficient warming of a large mass of air within the heat exchanger. Preferably, the heat exchanger ducts are relatively wide to promote maximum contact between the air to be heated and the inside bottom of the heat exchangers. Hence, a large volume of air may be passed therethrough and discharged into the room as a low velocity stream rather than as a high velocity jet.

The air intake and exhaust vents are preferably disposed in the housing such that heated air is circulated in the associated room in a direction which is reverse to normal heat convection. More specifically, the intake vent is located in the housing above the exhaust vent, preferably with the intake vent being disposed in a top housing panel and with two exhaust vents being located in a front housing panel on opposite sides of the intake vent longitudinally of the housing. The heated air at the exhaust vents is directed downwardly, under the cool air layer at the floor, such that the air circulates throughout the room in a circular fashion. As the cooler air is compressed upward by the warm air as it rises and is taken back into the heat unit at the intake vent, it is drawn from a vacuum zone created by the blower intake suction located adjacent to the face of the fireplace immediately above the hood.

The entire apparatus is made of lightweight materials. The heat exchanger is made of relatively thin, sheet steel and is protected by a high temperature, dull finish paint that not only resists corrosion but also promotes heat transfer therethrough. Since the heat exchanger of the present invention is not exposed to the severe environment of the grate-type of heat exchangers, such thin, lightweight and, therefore, economical materials are feasible. Also, since the entire apparatus operates in a relatively cool environment and discharges warm rather than hot air, repairs are seldom necessary and heat-induced damage is almost entirely obviated.

The novel features considered to be characteristic of the present invention are set forth in particular in the appended claims. The invention itself, however, together wth additional objects, features and advantages thereof, will be best understood from the following description when read in conjunction with the accompanying drawings in which:

Figure 1:
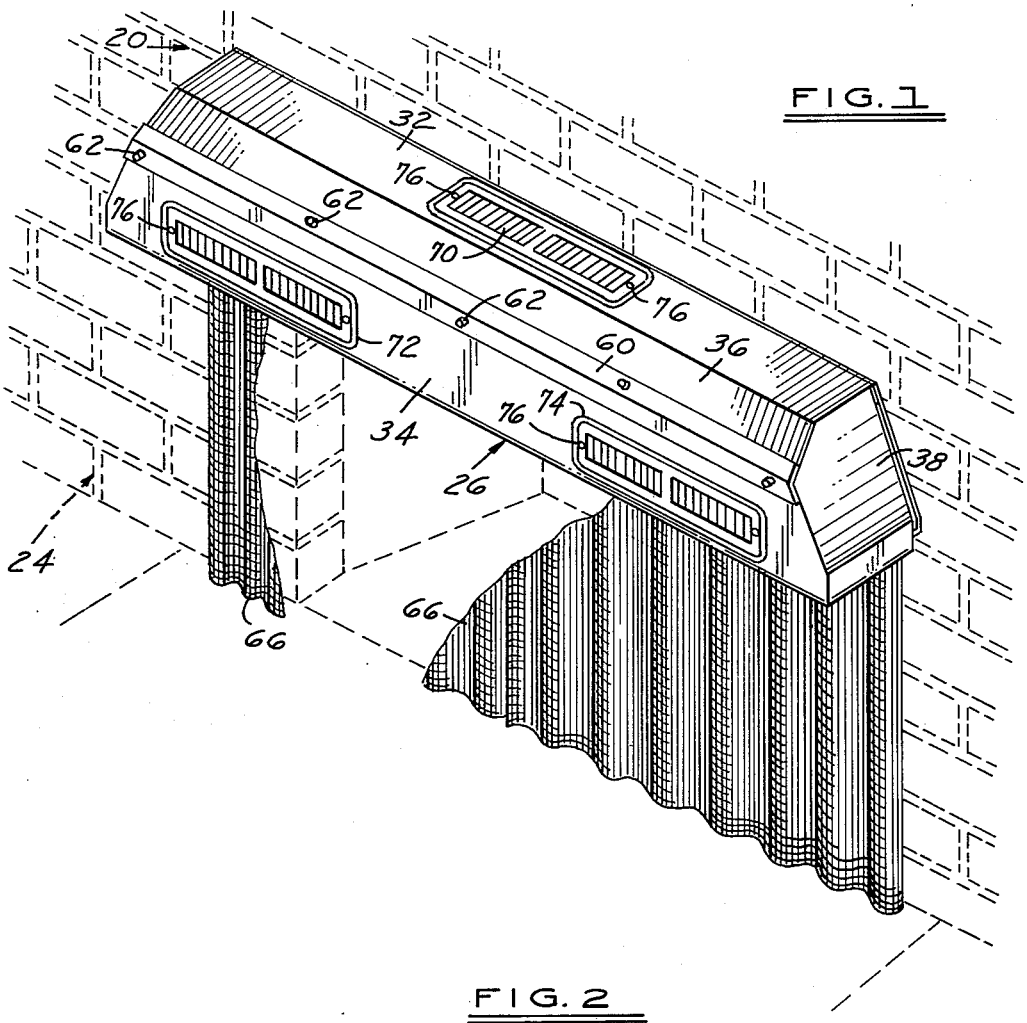
FIG. 1 is a perspective view showing a presently preferred embodiment of the combined fireplace hood and heating unit provided by the present invention installed in a typical fireplace.
Figure 4:
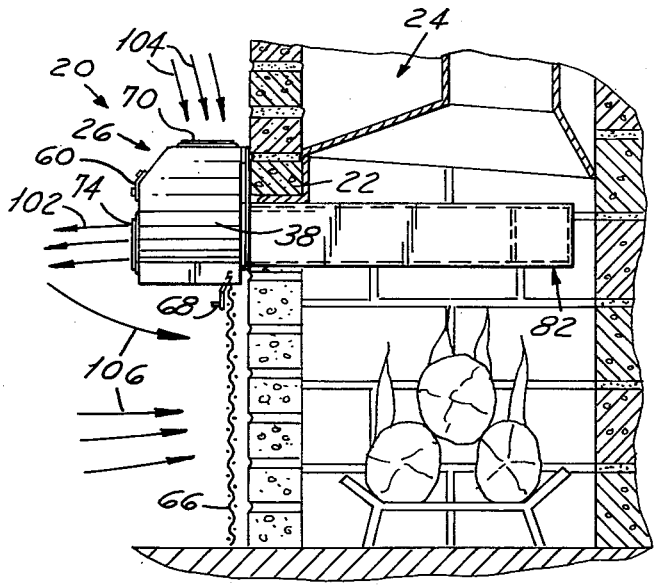
FIG. 4 is a side elevational view of the unit shownn in FIG. 1, again mounted in a fireplace, in which the fireplace is vertically centrally sectioned to better demonstrate the disposition of the combined fireplace hood and heating unit relative to the fireplace and fire area.
Figure 6:
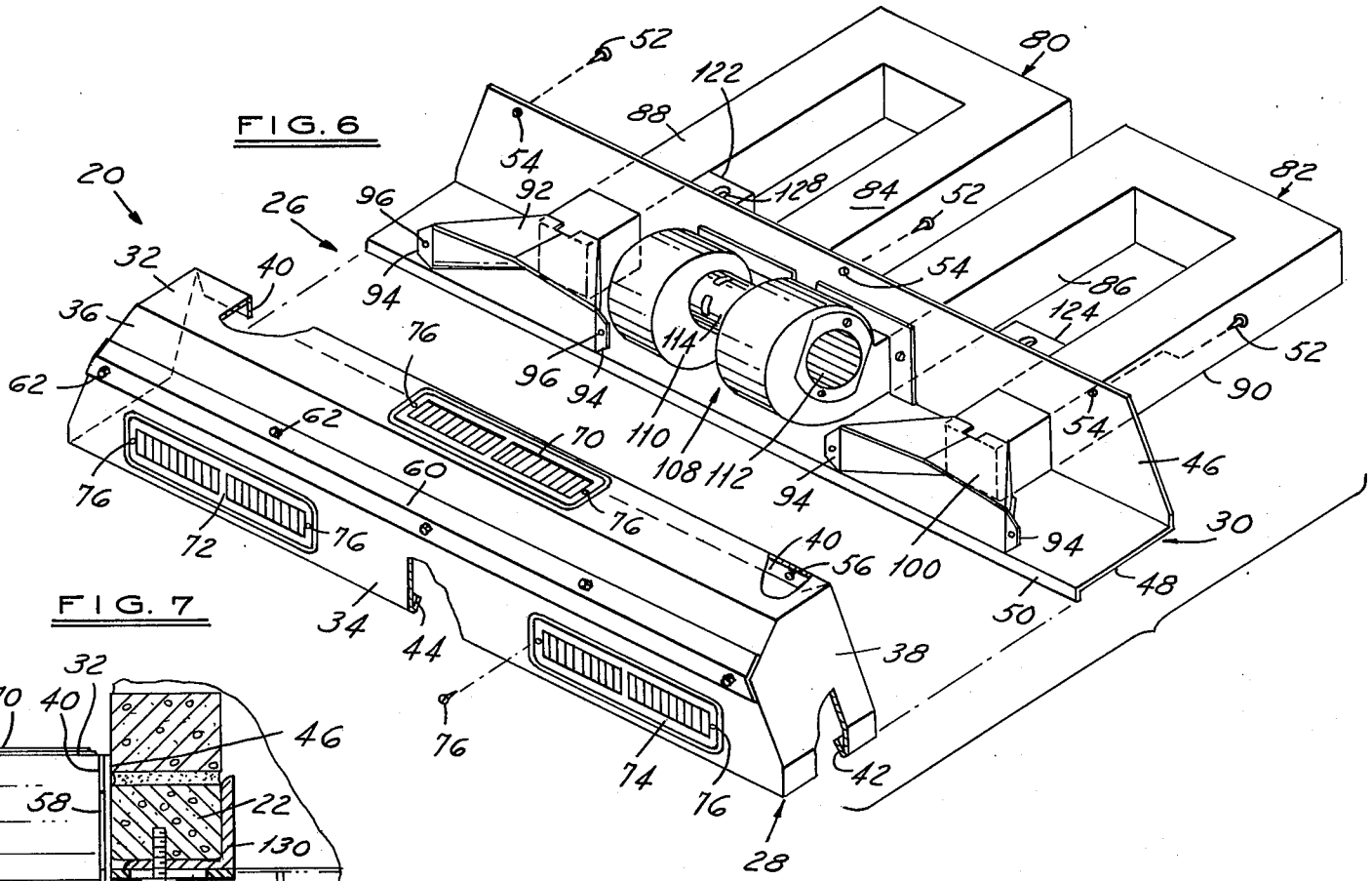
FIG. 6 is a perspective, partially exploded view of the combined fireplace hood and heating unit.
Figure 7:
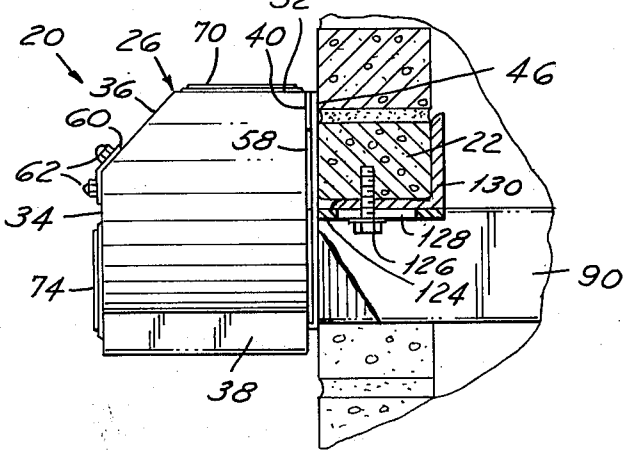
FIG. 7 is an enlarged view of one portion of FIG. 4.

Referring to the drawings, a presently preferred embodiment 20 of the combined fireplace hood and heating unit provided by the present invention is shown mounted to the lintel 22 of a conventional, pre-existing fireplace 24 (FIGS. 1, 4 and 7). Unit 20 includes a fireplace hood 26 formed as an elongated enclosure or housing having separable front and rear panel portions 28, 30, as best seen in FIG. 6. Front portion 28 includes a top panel 32, a front panel 34 and a downwardly sloping panel 36 contiguous at its longitudinal edges with and interconnecting top panel 32 with front panel 34 (all directional indications above and hereinafter being taken with respect to the mounted positon of the combined unit 20 within a fireplace). A pair of side panels 38 slope outwardly and downwardly from top panel 32 along the edges of panels 36,34. A downwardly directed flange 40 extends lengthwise along the rear edge of panel 32. The bottom edges of side panels 38 and front panel 34 terminate in upwardly bent flanges 42,44 respectively. Rear panel portion 30 includes a back panel 46 and a bottom panel 48 having a downwardly turned flange 50 extending along its front edge. In assembly of hood 26, front portion 28 is fitted over rear portion 30 with flange 50 received into the slot formed by flange 44 and adjacent lower edge of front panel 34. A plurality of sheet metal screws 52 extend through corresponding holes 54 in back panel 46 into holes 56 in flange 40 to firmly attach hood portions 28,30 to each other. It will be noted, with reference to FIG. 7 for example, that, viewed endwise of the assembled hood, the rear edges of end panels 38 terminate short of rear panel 46, thereby leaving a small gap 58 between the respective panels. The purpose of this gap will be explained hereinafter.

Figure 5:
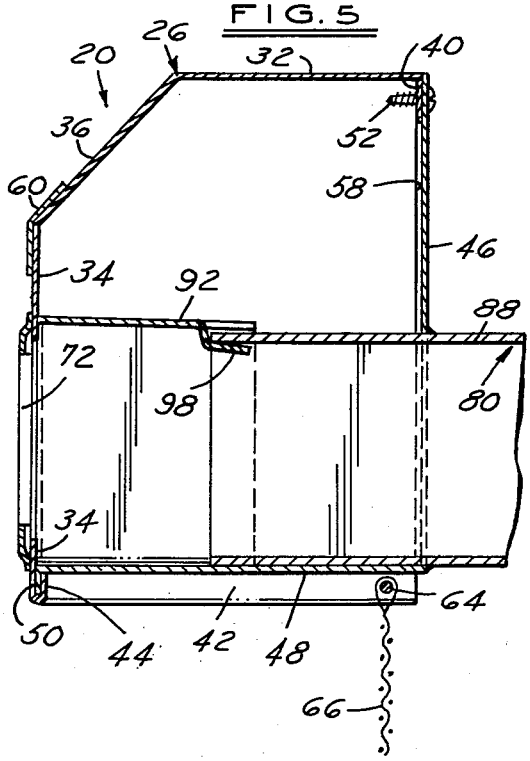
FIG. 5 is a vertical sectional view taken along the line 5—5 of FIG. 2.
Figure 3:
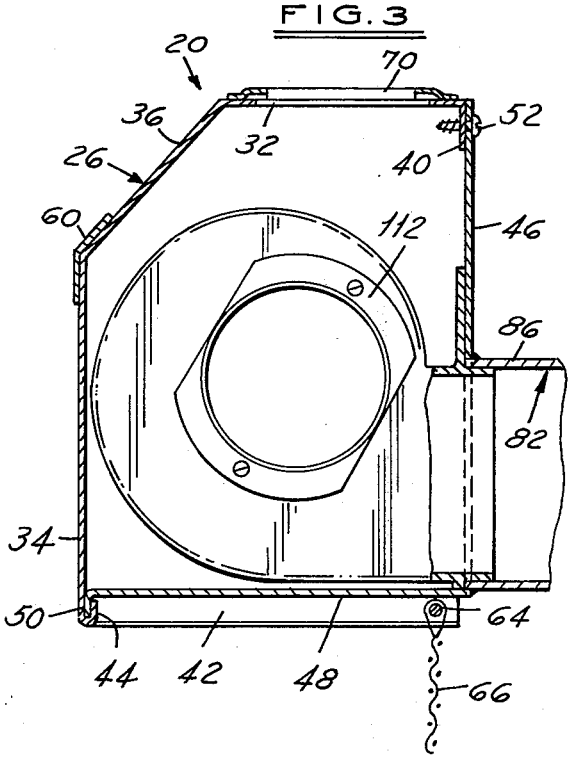
FIG. 3 is a vertical sectional view of the unit shown in FIG. 1 and is taken on the line 3—3 of FIG. 2.

A decorative strip 60 is carried lengthwise of hood 26 at the bend defined by panels 34,36, and is attached to the hood by a plurality of lock nuts 62 received over corresponding screws (not shown). A rod 64 (FIGS. 3 and 5) is fitted into corresponding holes (not shown) in flanges 42 and carries a conventional fireplace screen 66. Screen 66 is operated by the usual draw cables (not shown) and handles 68. An intake vent 70 and a pair of exhaust vents 72,74 are provided in the front or outwardly facing portion 28 of hood 26, i.e., that portion of the hood which is visible and open to the touch. More specifically, intake vent 70 is disposed in top panel 32 at substantially the longitudinal center of hood 26. Similarly, exhaust or discharge vents 72,74 are disposed in front panel 34 on respectively opposite sides of intake vent 70 lengthwise of the hood. Intake vent 70 and exhaust vents 72,74 may each comprise a plurality of directional louvers stamped into associated panels 32 during fabrication of hood portion 28, or may comprise separate louver plates, as shown in the drawings, fastened by sheet metal screws 76 over corresponding vent apertures in the associated panels.

A pair of generally U-shaped heat exchanging ducts 80,82 are carried by hood 26, ducts 80,82 having respective first ends 84,86 terminating at and fastened to rear panel 46 in registry with corresponding openings in the panel. Ducts 80,82 further include respective second ends 88,90 extending through and fastened to corresponding apertures in panel 46. A widely flared nozzle 92 has an intake fitted over the duct end 88 and an exhaust in registry with exhaust vent 72. A pair of ears 94 extend laterally outwardly from the front side edges of nozzle 92 and have formed therein the respective holes 96 into which louver-fastening screws 76 are received. A tab 98 (FIG. 5) is bent downwardly from the top of nozzle 92 and is received inside duct end 88 to hold the nozzle in position on rear panel portion 30 prior to assembly of front portion 28 thereto. A second nozzle 100 which is identical to nozzle 92 connects duct end 90 with exhaust vent 74. Thus, heat exchanging ducts 80, 82 are in open and common communication with intake vent 70 via the enclosure defined by hood 26, and connect the intake vent with the respective exhaust vents 72,74.

A brace 102 is fixedly welded or otherwise mounted between duct ends 84,86 inwardly of rear panel 46 to space the ducts from each other and to form with ducts 84,86 and panel 46 a stiffening box section for suport of the rear panel. It has been found that, without brace 102, heating of the ducts and heat from ducts 80,82 causes rear panel 46 to warp and buckle under severe operating conditions. Sufficient space is provided between duct ends 84,86 for passage therebetween of an appropriate fireplace damper closing lever or chain (not shown). Preferably, nozzles 92,100 are designed to direct heated air downwardly into the room at an angle calculated such that the warm exhaust air will hit the floor of the room about twelve feet from the fireplace front wall. Thus, downwardly directional nozzles 92,100, in combination with the disposition of exhaust vents 72,74 in front panel 34 and of intake vent 70 in top panel 30, promote a circular flow of air in the room in a direction opposite to the normal convection flow of heated air: i.e., heated air is blown downwardly under the cool air layer at the floor from exhaust vents 72,74 as depicted at 102 of FIG. 4. As the cooler air is compressed upward by the warm air as it rises and is taken back into the heating unit at the intake vent 70, it is drawn from a vacuum zone created by the blower intake suction located immediately above the hood as depicted at 104 in FIG. 4.

Moreover, the preferred dispostion of the intake and exhaust vents described above is believed to have a minimal effect upon the natural draft of the fireplace. In a typical domestic fireplace, the movement of convection currents and exhaust gasses through the flue and up the fireplace chimney is known to draw air from the room, including from elevations slightly above the lintel, beneath the lintel and into the fireplace. The action of this natural draft is depicted at 106 of FIG. 4. Location of intake vent 70 in front panel 34 or, worse, in bottom panel 48 would, due to suction pressures induced by blower operation, not only detract from this natural draft, but would also tend to draw smoke from the fireplace into hood 26, which smoke would thereafter be heated and ejected into the room.

A blower 108, comprisng a pair of centrifugal or squirrel cage fans 110,112 and a blower motor 114, is carried by panel wall 46 within hood 26, the respective outlets from fans 110,112 being aligned with duct ends 84,86. Thus, cold air entering vent 20 will circulate throughout the volume defined by hood 26 and cool both the hood panels and the components, especially motor 114, carried therewithin. This cooling of the hood panels is further enhanced by the above-mentioned slots 58 at the respective sides of hood 26, which slots provide two additional intake vents wich allow a small draft of air to be pulled into the hood from the opposite longitudinal ends thereof and pass along the hood panels toward the centrally disposed blower. In practice, the slots 58 may be on the order of 0.125 inches wide and should thus admit only a small percentage of the total amount of air taken into the hood, as on the order of five percent, the remaining 95 percent being taken in via the main intake vent 70. These additional small intake vents, in a normal installation, are disposed laterally beyond the side edges of the fireplace opening and thus, like vent 70, do not tend to draw in smoke from the fireplace or disturb the natural convection flow into the fireplace. In one working embodiment of the present invention blower 108 moves air through the heat exchangers 80,82 at a rate of about one hundred fifty cubic feet per minute.

Figure 2:
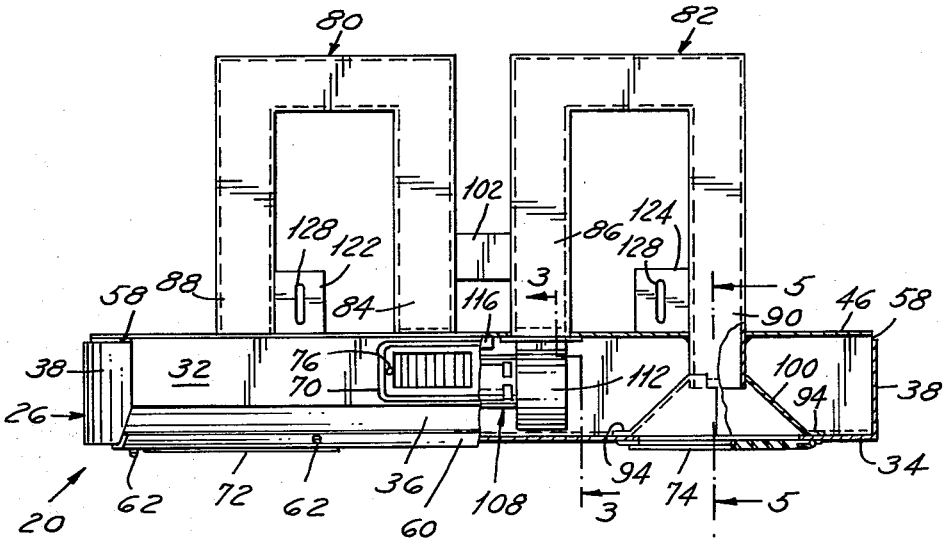
FIG. 2 is a top view of the unit shown in FIG. 1 with some parts broken away to show the interior of the housing.

The above-described two-piece construction of hood 26 also helps maintain the outer or front hood portion 28, i.e., that portion of the hood which is exposed to the touch, at a safe temperature. The lower portion of rear panel 46 and bottom panels 48 are exposed to direct radiation from the fire and will, therefore, tend to become hot. In accordance with presently preferred embodiments of the invention as above-described, the contact between flange 40 and rear panel 46 tends to be concentrated in the area of screws 52 with a layer of air separating the flange and panel for the remaining length of the hood, whereby heat transfer between rear panel 46 and front hood portion 28 is minimized. Similarly, the flange-in-groove arrangement between flanges 44,50 does not intimately connect bottom panel 48 to front panel 34, and therefore retards heat transfer therebetween. It will be recognized, of course, that such heat transfer may be further retarded by providing a layer of insulation along the inside or outside of rear panel 46. Furthermore, the outside surfaces of panels 46,48 may be coated or covered with suitable material, such as aluminum foil laminated to an asbestos panel, to reflect radiation from the fire, where desired, thereby minimizing heat transfer to the hood as a whole. A thermostatic switch 116 (FIG. 2) is carried by rear panel 46 between and in close proximity to duct ends 84,86, and allows the air within fireplace 24 to reach a preselected temperature before turning on motor 114. This prevents initial circulation and discharge of cold air into the room.

Disposition of blower 108 within hood 26 to push rather than pull air through ducts 80,82 yields yet another advantage in the situation where heat and/or corrosion has eaten a hole in one of the ducts. In such a situation, when a fire is initially started and the blower is not yet operating, smoke would leak into the duct and thence out the exhaust vents 72,74. However, because vents 72,74 are located adjacent the area of natural draft of room air into the fireplace, as discussed above in connection with FIG. 4, the smoke which exits vents 72,74 will tend to be drawn back into the fireplace and up the chimney. Furthermore, when the temperature in the fireplace reaches the temperature at which thermostat 116 closes, air pushed into the leaking duct by the associated fan 110,112 will create a positive pressure differential in the duct which, in turn, tends to push the smoke back out the leak and to keep further smoke from entering. Thus, the combined fireplace hood and heating unit provided by the present invention continues to operate, albeit at a slightly reduced efficiency, in spite of a leak in one of the heat exchanging ducts. Moreover, smoke exiting one of the vents 72,74 before the blower turns on provides an indication to a room occupant that the associated duct is leaking and should be repaired.

Figure 9:
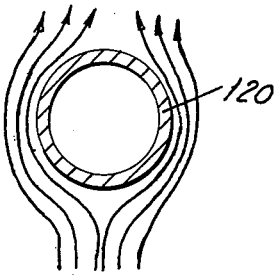
FIGS. 8 and 9 are schematic diagrams of the flow patterns of heated air around two heat exchanger geometries.
Figure 8:
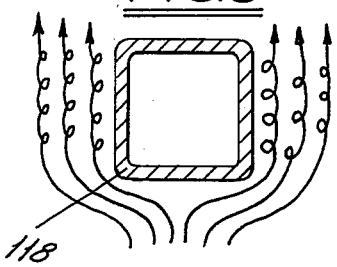

In the preferred embodiment of the present invention and as shown in the drawings, heat exchanging ducts 80,82 are substantially rectangular in transverse cross section and are carried above the base of the fireplace at a level at which flames from the fire impinge upon the bottom of the ducts. The position of ducts 84,86 relative to the fire is best exemplified in FIG. 4. It has been found that this cross sectional configuration of ducts 80,82 inhibits the creation of a boundary layer or a partial vacuum around each duct which tends to insulate the duct from convection currents rising from the fire. To illustrate, the flow of hot air convection currents around a heat exchanger 118 of rectangular cross section is schematically exemplified in FIG. 8. Hot air, assumed to have a substantially laminar flow pattern prior to impingement upon duct 118, flows upwardly and is incident upon the bottom of the duct. At this point, smooth flow of the air is interrupted and the air must traverse a right angle bend in the duct outer surface. As a result, the air assumes a turbulent flow pattern as it travels up the sides of the duct, with resultant eddies along the sides and top surfaces of the ducts, thereby insuring more intimate, heat-exchanging contact between the air and duct surface. This may be contrasted with the substantially laminar streamlined flow pattern around the circularly cross sectional heat exchanger 120 in FIG. 9. Although some heat is transferred to duct 120, boundary layers around the more aerodynamic surface of the duct render such heat transfer much less efficient than that exemplified in FIG. 8.

It is further preferred that the U-shaped ducts 80,82 be squared at the corners thereof, as shown in the drawings, to promote turbulence in the air stream blown therethrough. Such turbulence interiorly of the ducts slows the forced air passing through the ducts, and likewise creates eddy currents therein, breaking up formation of boundary layers and thereby allowing a greater amount of heat to be transferred from the interior surface of the ducts to the interior air currents. The cross sectional areas of ducts 80,82 are preferably large relative to the output capacity of blower 108 such that, although a large volume of air is moved through the ducts with a relatively high entrance velocity, the air movement is slowed so that it is discharged into the room at relatively low velocity. The outer surfaces of ducts 80,82 are preferably coated with a heat and corrosion resistant paint having a relatively dull finish to enhance the exhange of energy between the fire convection currents and the air in the ducts. In the abovementioned working embodiment of the invention having a one hundred fifty cubic feet per minute blower capacity, ducts 80,82 each have a wall thickness of about 0.060 inches and a rectangular cross sectional area of about 5.3 square inches. The heated exhaust from this embodiment has a temperature of about 180° F.

A pair of brackets 122,124 are welded or otherwise fixedly mounted to duct ends 84,86 for mounting the combined fireplace hood and heating unit 20 as an assembled unit to the lintel 22 of a pre-existing fireplace. Referring specifically to FIG. 7, a pair of bolts 126 pass through corresponding apertures 128 in brackets 122,124 into holes previously bored through the lintel support plate 130 and into the fireplace lintel. In accordance with yet another feature of the present invention and as will be apparent from examination of FIG. 2, the brackets 122,124 are carried at the front-to-back center of gravity of unit 20. Thus, rocking or tilting of the unit during assembly thereof to the lintel 22 is greatly reduced, thereby facilitating the entire mounting procedure. Furthermore, with the mounting bolts carrying unit 20 at substantially the front-to-back center of gravity thereof, bending moments on the mounting bolts are eliminated. In most residential fireplaces, and as depicted in FIGS. 4 and 7, the lower surface of the lintel 32 upon which the combined unit 20 is to be mounted is relatively narrow as compared with the front-to-back dimension of the unit. Hence, in many applications, it would be difficult to provide several bolts, spaced in the front-to-back direction, to accommodate stresses caused by unit unbalance. By mounting the unit at its center of gravity, this problem is obviated. Moreover, the center-of-gravity mounting arrangement provided by the invention eliminates any requirement for unbalance support brackets inside the front wall or on the back wall of the fireplace. Thus, if the unit is for any reason removed from the fireplace, the mounting holes are substantially hidden from view and the fireplace remains fully operational. Apertures 128 may be slotted in the front-to-back direction to insure that, when the combined unit 20 is mounted in position, the rear panel 46 of hood 26 is flush against the front wall of the fireplace.

It will also be noted that, when the combined unit 20 provided by the present invention is mounted to the fireplace as described, hood 26 is carried externally of the fireplace with the heat exchanging ducts 80,82 cantilevered rearwardly from hood 26 over the fire area. Thus, the burning logs or charcoal, etc. do not come into direct contact with the ducts, whereby the lifetime thereof is greatly increased. Furthermore, with hood 26 carried externally of the fireplace and with the cool air intake at vent 70 and slots 58 tending to cool the hood panels or walls as described above, the hood remains relatively cool to the touch during operation of the unit.

As will be self-evident with reference to FIGS. 1 and 4, the fireplace opening in the area beneath the combined fireplace hood and heating unit 20 remains unobstructed by the structure of the heating unit, and thereby provides easy access to and viewing of the fireplace hearth through the fireplace opening and screen 66.

It will now be apparent that there has been provided in accordance with the present invention a combined fireplace hood and heating unit which fully satisfies all of the objects, aims and advantages set forth above. Although the invention has been described in connection with a specific embodiment thereof, it will be evident that many alternatives, modifications and variations will suggest themselves to persons skilled in the art in view of the foregoing description. For example, although it is presently preferred to construct heat exchanging ducts 80,82 to have a rectangular cross section, it will be evident that other cross sectional geometries, such as circular or oval, may be used without derogating other features of the invention specifically, without changing the external appearance of hood 26 which constitutes an important aspect of the invention. Similarly, intake vent 20 and exhaust vents 72,74 could be reversed or otherwise relocated and, although the room air would not circulate in the preferred manner described, the external appearance of the hood would not be materially changed. Accordingly, the invention is intended to embrace all such alternatives, modifications and variations as fall within the spirit and broad scope of the appended claims.

The invention claimed is:

1. A combined fireplace hood and heating unit adapted to be mounted as an assembled unit into a pre-existing fireplace having a fireplace hearth and a fireplace opening defined by opposing side wall edges and a lintel bridging said edges, said unit comprising an elongated housing, means providing intake and exhaust vents in said housing, tubular heat exchanging means carried by and extending from said housing and interconnecting said intake and exhaust vents, a blower mounted in said housing for forcibly moving air from said intake vent through said heat exchanging means to said exhaust vent, and means for supporting said housing from a fireplace adjacent the lintel such that opposite longitudinal ends of said housing project at least to opposite side edges of the fireplace opening and at least a portion of said housing including said intake and exhaust vents is carried externally of said fireplace as a fireplace hood above the upper portion of the fireplace opening, said heat exchanging means extending rearwardly from said housing above the fireplace hearth, and such that said fireplace opening in the area thereof beneath said hood and heating unit remains unobstructed by the structure of said unit to provide easy access to and viewing of the fireplace hearth through the fireplace opening.

2. The combined fireplace hood and heating unit of claim 1 further including a foldable fire screen attached to said housing and depending therefrom.

3. The unit set forth in claim 1 further comprising means carried by said housing and responsive to the temperature within said fireplace to energize said blower when the temperature within said fireplace exceeds a preselected temperature.

4. The unit set forth in claim 3 wherein said blower comprises an electric motor, and wherein said temperature responsive means comprises a thermal switch electrically connected between said motor and a source of electric power.

5. The combination set forth in claim 1 wherein said means for supporting said housing comprises means for mounting said housing to the fireplace lintel such that said housing extends horizontally above said fireplace opening and overlaps the fireplace side wall edges.

6. The combination set forth in claim 1 wherein said housing comprises the only air flow connecting means between said blower and said intake vent, such that air entering through the intake vent tends to circulate through said housing and cool components disposed therein including said blower before being forced through said heat exchanging means by said blower.

7. The fireplace hood and heating unit set forth in claim 1 wherein said housing ends project beyond the opposite side edges of the fireplace opening in the mounted position of said unit, and wherein said unit further comprises means adapted for mounting a foldable screen beneath said housing to depend therefrom.

8. The fireplace hood and heating unit set forth in claim 1 wherein the entire said housing and said blower are carried externally of said fireplace.

9. The unit set forth in claim 1 wherein said means providing said intake vent includes means locating intake vents on opposite longitudinal ends of said hood.

10. The unit set forth in claim 1 comprising two exhaust vents disposed in a front wall of said housing and spaced from each other lengthwise of said housing, and wherein said heat exchanging means comprises two heat exchanging ducts having first ends in common communication with said intake vent and second ends in respective communication with said two exhaust vents.

11. The unit set forth in claim 10 wherein said ducts are substantially U-shaped and are respectively cantilevered from said housing to extend into a fireplace when said housing is supported adjacent the fireplace lintel.

12. The unit set forth in claim 11 wherein said heat exchanging ducts are rectangular in cross section transversely of said ducts.

13. A combined fireplace hood and heating unit comprising an elongated enclosed housing having the appearance of a fireplace hood and having two discharge vents on the front thereof and intake vent means, a dual-fan electrically powered blower mounted in the housing, two tubular heat exchangers, each rectangular in cross section and U-shaped, one end of each being connected to one of the fans and the other end of each being connected to one of the discharge vents, the central portions thereof extending in cantilever fashion outside the housing, through the wall thereof, directional louvers in the discharge vents, means for mounting the housing to a fireplace so that the heat exchangers may extend over the fire, and a fire screen attached to and depending from the housing.

14. A combined fireplace hood and heating unit adapted to be mounted as a unit into a pre-existing fireplace having an opening defined by opposing side wall edges and a lintel bridging said edges, said lintel and side wall edges being disposed in and partly defining a fireplace front wall, said unit comprising an elongated housing, means providing intake and exhaust vents in said housing, heat exchanging means carried in cantilevered fashion rearwardly from said housing and interconnecting said intake and exhaust vents, a blower mounted in said housing for forcibly moving air from said intake vent through said heat exchanging means to said exhaust vent, and means for suspending said housing from the lintel of a fireplace such that at least a portion of said housing is carried externally of said fireplace, said lastnamed means being located at the substantial front-to-back center of gravity of said unit.

15. The unit set forth in claim 14 wherein said lastnamed means is carried at the rear of said housing such that the entire said housing is carried externally of the fireplace opening when said unit is suspended from the fireplace lintel, said housing having a rear wall substantially flush with the front wall of the fireplace.

16. A combined fireplace hood and heating unit adapted to be mounted as a unit to a pre-existing fireplace having a fireplace opening and a fireplace hearth, said unit comprising a hood having the form of an elongated, enclosed housing, means providing intake and exhaut vents in said housing, heat exchanging means connecting said intake and exhaust vents, a blower carried within said hood to forcibly move air through said heat exchanging means, and means supporting said unit in the upper portion of said fireplace opening beneath the fireplace lintel such that said hood is carried externally of said fireplace and said heat exchanging means extend horizontally over the fireplace hearth, the rearward end of said heat exchanging means being spaced from the back wall of the fireplace.

17. The combination set forth in claim 16 wherein said supporting means is carried by said exchanging means adjacent said hood, and wherein both said hood and said heat exchanging means are cantilevered from said mounting means.

18. A combined fireplace hood and heating unit adapted to be mounted as an assembled unit into a pre-existing fireplace, having a fireplace opening said unit comprising a hood having the form of an elongated housing and including at least top and front panels, means providing an intake vent in said top panel and at least one exhaust vent in said front panel, heat exchanging means carried by said housing and interconnecting said intake and exhaust vents, a blower mounted in said housing for forcibly moving air from said intake vent through said heat exchanging means to said exhaust vent, and means for mounting said housing adjacent the lintel of a fireplace such that said housing extends horizontally over the opening of a fireplace.

19. The unit set forth in claim 18 wherein opposite longitudinal ends of said hood project beyond opposite side edges of the fireplace opening.

20. The unit set forth in claim 19 further comprising side intake vents on opposite longitudinal ends of said hood, said side intake vents allowing only a small amount of air into said hood as compared to said intake vent in said top panel.

21. The unit set forth in claim 20 wherein said hood further includes side and rear panels, said side panels extend from said front panels toward said rear panel, said side intake vents comprising slot openings between said side and rear panels on respective longitudinal ends of said hood.

22. The unit set forth in claim 18 wherein said front panel has two exhaust vents disposed therein, said exhaust vents being spaced from each other lengthwise of said housing, and wherein said heat exchanging means comprises two heat exchanging ducts, said ducts having first ends in common communication with said intake vent and second ends in respective communication with said two exhaust vents.

23. The unit set forth in claim 22 wherein said ducts are substantially U-shaped and are respectively cantilevered from said housing to extend into a fireplace when said housing is mounted adjacent to the fireplace lintel.

24. The unit set forth in claim 22 wherein said heat exchanging ducts are rectangular in cross section transversely of said ducts.

25. The unit set forth in claim 22 wherein said housing forms an enclosed volume, said intake vent being open to said enclosed volume, said blower being mounted within said volume to force air from within said volume through said heat exchanging ducts and out said exhaust vents.

26. The unit set forth in claim 25 wherein said blower comprises a dual-fan blower and wherein said ducts are substantially U-shaped and are carried side-by-side longitudinally of said hood, said first duct ends being inside legs of said U's and in alignment with respective outlets from said dual fans, said second duct ends being outside legs of said U's and in alignment with respective ones of said outlet vents.

27. The combined fireplace hood and heating unit of claim 22 wherein said heat exchanging means comprises a pair of U-shaped ducts arranged symmetrically about the longitudinal center of said housing, so that the damper lever of a typical fireplace may be operated between said ducts.

28. The combined fireplace hood and heating unit of claim 18 further comprising directional louvers in said intake and exhaust vents and a directional duct between said heat exchanging means and said exhaust vent.

29. The combined fireplace hood and heating unit of claim 28 wherein said louvers and said directional ducts at the discharge vents are slanted to direct heated air passing therethrough downwardly to promote a circular flow of air in a room to be heated.

30. The combination comprising a fireplace having a fireplace hearth and a fireplace opening defined by opposing side wall edges and a lintel bridging said edges and a combined fireplace hood and heating unit mounted as a unit to said fireplace, said unit comprising an elongated housing, means providing intake and exhaust vents in said housing, tubular heat exchanging means carried by and extending from said housing and interconnecting said intake and exhaust vents, a blower mounted in said housing for forcibly moving air from said intake vent through said heat exchanging means to said exhaust vent, and means for supporting said housing from a fireplace adjacent the lintel such that opposite longitudinal ends of said housing project at least to opposite side edges of the fireplace opening and at least a portion of said housing including said intake and exhaust vents is carried externally of said fireplace as a fireplace hood above the upper portion of the fireplace opening, said heat exchanging means extending rearwardly from said housing above the fireplace hearth, and such that said fireplace opening in the area thereof beneath said hood and heating unit remains unobstructed by the structure of said unit to provide easy access to and viewing of the fireplace hearth through the fireplace opening.

31. A fireplace heating unit adapted for use with a fireplace having a fireplace hearth and a fireplace opening affording access to the hearth, said unit comprising a housing adapted to be located at a preselected position within a fireplace, an intake vent located in a top wall of said housing to accept air from a zone immediately above the fireplace opening in the mounted position of said unit, an exhaust vent located in a front wall of said housing to discharge air into a zone generally beneath the level of said heating unit in the mounted position of said unit, heat exchange means connecting said intake vent and said exhaust vent, blower means to move air through said heat exchange means from said intake vent to said exhaust vent, and means for removably locating said unit within a fireplace such that said intake vent is directed outwardly from the upper portion of the fireplace opening and said heat exchange means extends rearwardly over the fireplace hearth, and such that air heated within said unit and exhausted therefrom is circulated externally thereof in a substantially circular direction opposite to the direction of natural convection of such heated air.

32. The unit set forth in claim 31 wherein said unit further comprising means at said exhaust vent directing air downwardly as it is exhausted, whereby said reverse convection circulation is enhanced.

* * * * *

UNITED STATES PATENT AND TRADEMARK OFFICE

CERTIFICATE OF CORRECTION

PATENT NO. : 4,112,914

DATED : Sept. 12, 1978

INVENTOR(S) : REX M. BROWN

It is certified that error appears in the above-identified patent and that said Letters Patent are hereby corrected as shown below:

Column 1, lines 27 and 28: "membes" should be -- members --

Column 3, line 27, "shownn" should be -- shown --
Column 5, line 35, "wich" should be -- which --
Column 7, line 45, "32" should be -- 22 --

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*